US009899207B2

(12) United States Patent
Petter et al.

(10) Patent No.: US 9,899,207 B2
(45) Date of Patent: Feb. 20, 2018

(54) VIBRATION RESISTANT AUTOMOTIVE FRONT LIGHTING LAMP

(71) Applicant: KONINKLIJKE PHILIPS N.V., Eindhoven (NL)

(72) Inventors: Markus Petter, Eindhoven (NL); Helmut Tiesler-Wittig, Eindhoven (NL); Bernd Schönfelder, Eindhoven (NL); Johannes Gerhard Möeller, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 75 days.

(21) Appl. No.: 15/025,388

(22) PCT Filed: Sep. 29, 2014

(86) PCT No.: PCT/EP2014/070741
§ 371 (c)(1),
(2) Date: Mar. 28, 2016

(87) PCT Pub. No.: WO2015/052023
PCT Pub. Date: Apr. 16, 2015

(65) Prior Publication Data

US 2016/0217996 A1 Jul. 28, 2016

(30) Foreign Application Priority Data

Oct. 9, 2013 (EP) ..... 13187951

(51) Int. Cl.
*H01K 9/08* (2006.01)
*H01K 1/26* (2006.01)
(Continued)

(52) U.S. Cl.
CPC ..... *H01K 9/08* (2013.01); *F21S 48/1109* (2013.01); *F21S 48/1172* (2013.01); *F21S 48/13* (2013.01); *H01K 1/22* (2013.01); *H01K 1/26* (2013.01)

(58) Field of Classification Search
CPC .. H01K 9/08; H01K 1/26; H01K 1/46; H01K 1/22; F21S 48/1172; F21S 48/1109; F21S 48/13
See application file for complete search history.

(56) References Cited

U.S. PATENT DOCUMENTS 3,646,386 A * 2/1972 Rijnders ..... H01K 9/08 313/115
3,774,064 A * 11/1973 Vause ..... H01K 1/66 313/273
2016/0225605 A1* 8/2016 Schonfelder ..... H01K 1/18

FOREIGN PATENT DOCUMENTS

DE 3616673 A1 11/1987
EP 0817243 A2 1/1998
(Continued)

OTHER PUBLICATIONS

EPO as ISA, PCT/EP2014/070741, filed Sep. 29, 2014, "International Search Report and Written Opinion" dated Jun. 1, 2015, 16 pages.

*Primary Examiner* — Sonji Johnson

(57) ABSTRACT

A lamp for automotive front lighting and a vehicle headlight comprising the lamp are described, as well as a method of manufacturing the lamp. The lamp 10 comprises a base 12 for mechanical and electrical connection to an automotive headlight 50. A burner 14 is fixed to the base 12 and comprises a sealed transparent vessel 22. A first filament 34 is arranged within the vessel 22. A holding wire 30*c* is arranged within the vessel, and a baffle 40 is arranged proximate to the first filament 34 to partially shield light
(Continued)

emitted from the first filament 34. The baffle 40 is fixed to the holding wire 30*c*. The transparent vessel 22 comprises a vessel wall including a cylindrical portion 24 surrounding the first filament 34. In order to obtain a lamp which may withstand vibration, a support member 38, 138, 238 is provided including at least a first part 39 fixed to the baffle 40 or to the holding wire 30*c* and a second part 43 which is in contact with the cylindrical portion of the vessel 22. The support member 38, 138, 238 comprises a flexible intermediate part 37 connecting the first and second parts, such that the baffle 40 or the holding wire 30*c* is supported resiliently against the vessel 22.

11 Claims, 3 Drawing Sheets

(51) Int. Cl.
*F21S 8/10* (2006.01)
*H01K 1/22* (2006.01)

(56) References Cited

FOREIGN PATENT DOCUMENTS

| | | | |
|---|---|---|---|
| EP | 0284117 | A1 | 9/1998 |
| SU | 431581 | A1 | 7/1975 |
| SU | 571846 | A2 | 9/1977 |

* cited by examiner

VIBRATION RESISTANT AUTOMOTIVE FRONT LIGHTING LAMP

CROSS-REFERENCE TO RELATED APPLICATIONS

The present application is a § 371 application of International Application No. PCT/EP2014/070741 filed on Sep. 29, 2014 and entitled "Vibration Resistant Automotive Front Lighting Lamp," which claims priority to European Patent Application No. 13187951.2, filed Oct. 9, 2013. Both PCT/EP2014/070741 and 13187951.2 are incorporated herein.

FIELD OF THE INVENTION

The invention relates to an electrical lamp, and in particular to a lamp for use in automotive vehicle front lighting. The invention further relates to a vehicle headlight.

BACKGROUND OF THE INVENTION

Automotive headlights, i.e. headlights for use on board of a vehicle, such as e.g. a car, motorcycle, truck or other type of vehicle generally comprise a reflector and, mounted therein, a lamp. Known incandescent lamps, in particular halogen lamps, generally comprise a base and a burner. The base provides mechanical and electrical connection to the automotive headlight, whereas the burner comprises the actual light-emitting element, in particular filament. Light emitted from the filament is reflected by the reflector to form a beam for illumination in front of the vehicle.

Different types of incandescent lamps are known, which comprise one or more filaments arranged within a vessel.

SU431581A1 describes a lamp with a tubular bulb and a part which serves for securing the filament including a shield. To improve the dynamic stability of the lamp and reduce the amount of dazzle, the shield includes a flat member shown to be arranged perpendicular to the axis of the filament which engages the inner side surface of the bulb at several positions. The size of the member corresponds to the inner diameter of the bulb and acts as a guide when being inserted in the lamp. The member automatically centers the lamp stem along the axis of the bulb and restricts vibration of the shield inside the bulb when subjected to dynamic loads. The shape of the member is chosen such that it does not prevent the halogen cycle.

SUMMARY OF THE INVENTION

According to an aspect of the invention, a lamp according to claim 1 and a vehicle headlight according to claim 11 are proposed.

A lamp according to an aspect of the invention comprises a base for mechanical and electrical connection to an automotive headlight. Electrical contacts may protrude out of the base, in particular from the rear thereof. The base further preferably comprises a positioning ring which serves for mounting the lamp in a reflector of a vehicle headlight in a defined position and orientation. The positioning ring may comprise radial protrusions, which may serve for mechanical fixing, and for exact positioning. It is in particular preferred to provide one reference protrusion to define a radial reference direction R.

The lamp further comprises a burner with a sealed vessel, at least partially transparent, preferably of quartz glass. According to the invention, at least a first filament is arranged within the vessel. In preferred embodiments, a second filament may be arranged within the vessel, provided at a distance from the first filament. Preferably, the filaments are spaced along the longitudinal axis X of the lamp, i.e. the axis extending centrally through the positioning ring.

According to one aspect, a baffle is arranged proximate to a first filament. As will become apparent in connection with preferred embodiments, the baffle may in particular be arranged to cover the axial range of the first filament, i.e. be arranged in radial directions of the first filament along the whole axial length thereof. Thus, a portion of the light emitted from the first filament, emitted into spatial directions of the proximate baffle, will be shaded by the baffle.

At least one holding wire is arranged within the vessel. In preferred embodiments, two or three holding wires are provided. The holding wires may be fixed in a pinch seal of the vessel, and may project into its interior. At least one of the holding wires may serve to hold the baffle in its position proximate to the first filament. The baffle may be fixed to the holding wire, preferably welded thereto. Further, the first and second filaments may be fixed to the holding wires.

According to an aspect of the invention, the transparent vessel comprises a vessel wall which includes a cylindrical portion surrounding at least the first filament. According to an aspect of the invention, a support member is provided which is fixed to the baffle or to the holding wire. The support member includes at least a first part that is fixed to the baffle or holding wire, and a second part that is in contact with the cylindrical portion of the vessel. The support member further comprises at least one flexible intermediate part connecting the first and second parts, so that the baffle or the holding wire are resiliently supported against the vessel.

The thus formed resilient support does not completely immobilize the baffle within the vessel, but retains a certain movement, while at the same time resiliently restricting the movement. Under the influence of forces of inertia caused e.g. by vibration, the baffle and the holding wire may still move within and relative to the vessel, but the movement will be significantly less than without the support member. Thus, the lamp will be more resistant to vibration.

According to preferred embodiments, the support member may include a first and a second flexible intermediate part or leg, and each of the legs will comprise a second part in contact with the cylindrical portion. The second part of the first and second flexible legs may be arranged on the inside of the vessel at different positions distant from each other.

In a preferred embodiment, the second part is in one-sided contact with the interior of the vessel. Thus, preferably, the support member is not fixedly attached to the interior of the vessel. This facilitates manufacture of the lamp and allows a substantial degree of remaining flexibility.

According to a different embodiment, the flexible support member may be made out of a wire material, or out of a flat metal material. The material of the flexible support member may preferably be molybdenum. The metal material may be stamped and bent. In one embodiment, the flexible support member may even be formed in one piece with the baffle.

In a preferred embodiment, the flexible support member is positioned to be shaded from the first filament by the baffle. Thus, the support member, located behind the baffle as viewed from the first filament, will not lead to significant optical distortion.

According to a preferred embodiment of the invention, at least three holding wires are arranged to project into the interior of the vessel. The first filament, preferably also a second filament and the baffle are fixed to the holding wires.

A pinch seal is formed at a portion of the vessel, sealing the vessel and embedding the holding wires. Thus, the holding wires extend from the pinch seal into the interior of the vessel. Further, a holding bar is arranged within the interior of the vessel, distant from the pinch seal. The holding bar serves to hold the holding wires, preferably by at least partially enclosing the wires within the material of the holding bar. The holding bar is preferably made out of glass.

According to one embodiment, the base comprises three electrical contacts, and three holding wires are arranged extending from a pinch seal into the interior of the vessel. Each of the holding wires is electrically connected to one of the electrical contacts. The first filament is electrically connected between a first and a third holding wire, and the second filament is electrically connected between a second and the third holding wire. Thus, the filaments share a common electrical connection. Preferably, the first filament is not connected directly to the third holding wire, but electrical contact is established via the baffle fixed to the third holding wire.

In preferred embodiments, the baffle may be of concave shape, e.g. provided in one piece and made out of correspondingly shaped sheet metal, in particular molybdenum. A front surface of the baffle may be arranged at a front axial end of the baffle, preferably the end facing towards the base, arranged at least partially in between the filaments. Thus, the baffle may be effective to shield the second filament from light emitted from the first filament. The baffle then serves to separate angular ranges illuminated by both filaments from angular ranges illuminated only by the second filament, where light emitted from the first filament is shaded at the baffle. Corresponding portions of the reflector may be shaped to reflect light emitted from the first filament which may be denoted a low beam filament into a first beam (low beam, comprising a bright/dark cutoff) and correspondingly reflect light emitted from the second filament (e. g. high-beam filament) into a reflected beam (high beam) without a bright/dark cutoff.

According to a further aspect, a vehicle headlight with a reflector may be equipped with a lamp according to one of the above aspects. In particular, the vehicle headlamp may be a motorcycle headlamp.

These and other aspects of the invention will become apparent from and elucidated with reference to the embodiment described hereinafter.

DETAILED DESCRIPTION OF EMBODIMENTS

Figure 1:
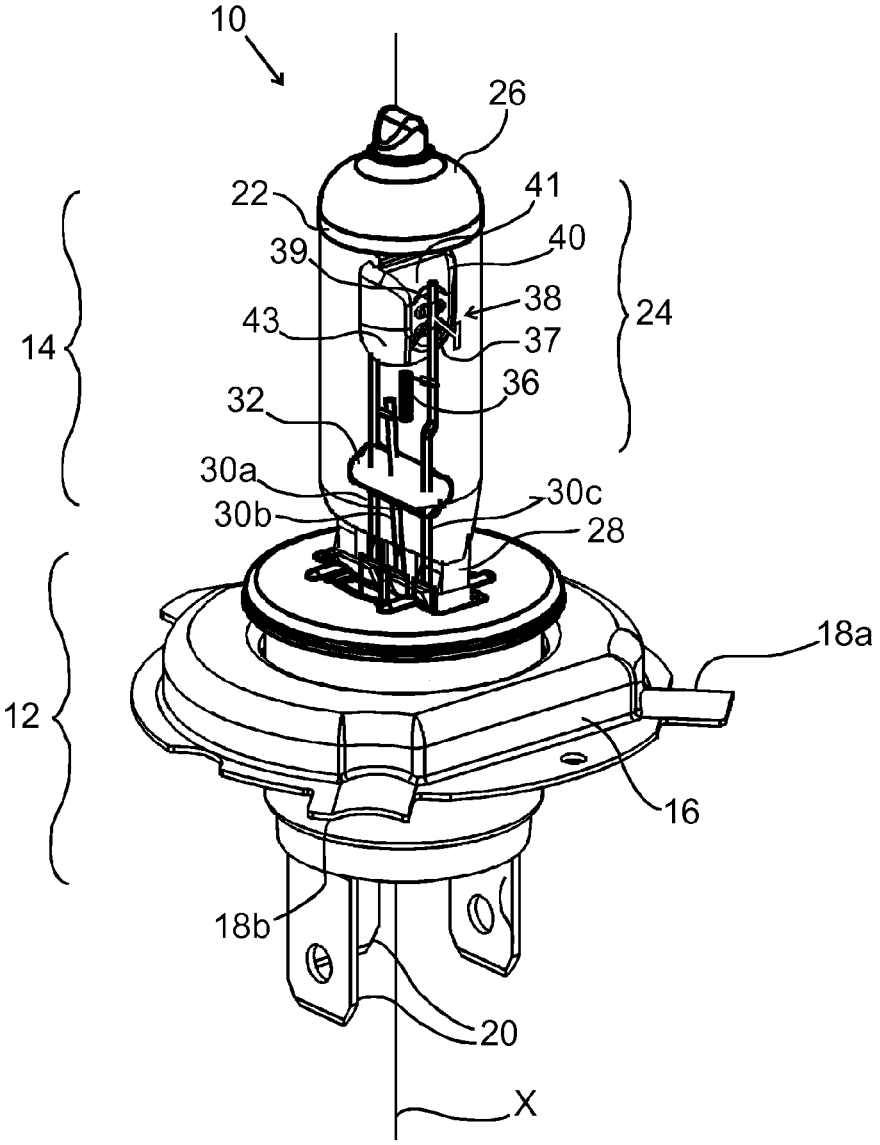
FIG. 1 shows a perspective view of a lamp according to a first embodiment of the invention.
Figure 2:
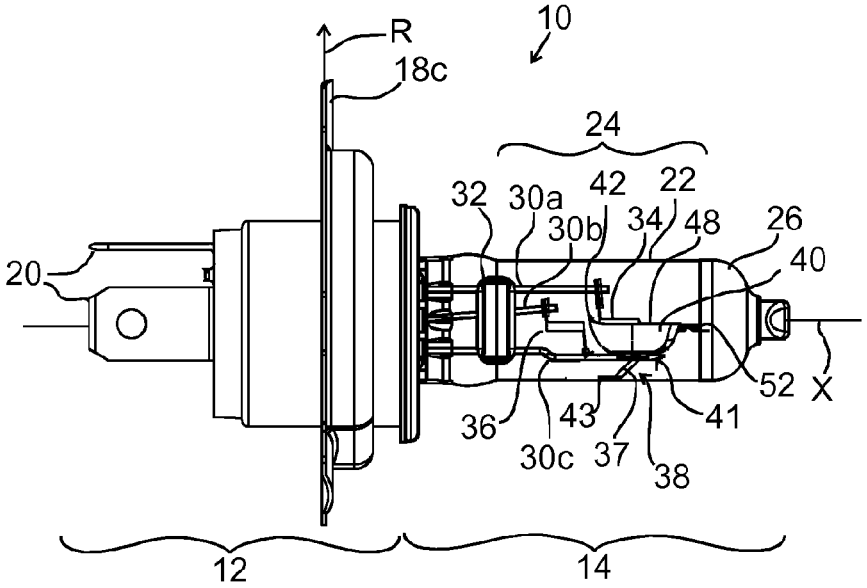
FIG. 2 shows a side view of the lamp of FIG. 1 in the horizontal operating position.

FIGS. 1, 2 show a first embodiment of an automotive halogen lamp 10.

The lamp 10 comprises a base 12 and a burner 14 fixed to the base 12.

The base 12 comprises a positioning ring 16 which includes three positioning protrusions 18*a*, 18*b*, 18*c* radially protruding from the base 12 (of which only two are shown in FIG. 1).

Figure 4:
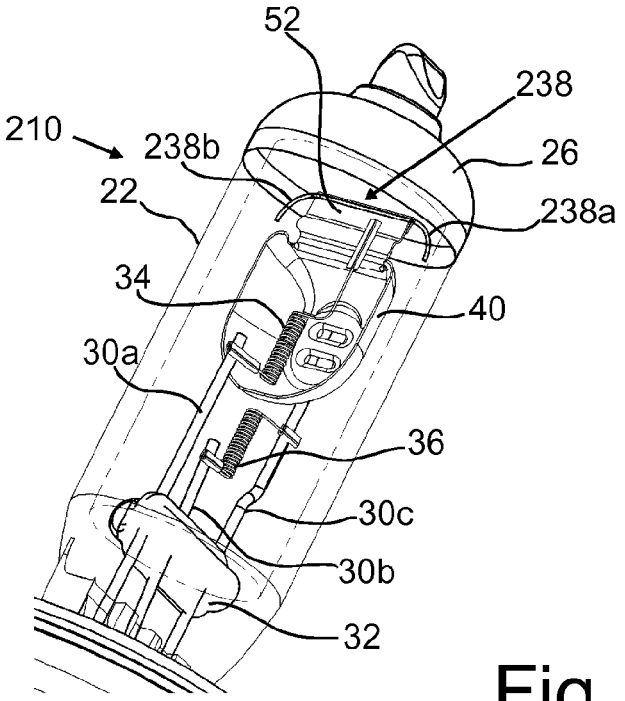
FIG. 4 shows an enlarged perspective view of a portion of a lamp according to a third embodiment.

The lamp 10 may be fixed to a vehicle headlight 50 as symbolically shown in FIG. 4. A protrusion 18*c* (shown in FIG. 2) serves as a reference protrusion defining a radial reference direction R. A reference plane is defined by the upper portions of the positioning protrusions 18*a*, 18*b*, 18*c* of the positioning ring 16. A longitudinal axis X of the lamp 10 is defined to run through the center of the positioning ring perpendicular to the reference plane. A symmetry plane may be defined by the radial reference direction R and the longitudinal axis X.

The burner 14 comprises a glass vessel 22 of quartz glass material with a central portion 24 of generally circular cylindrical shape. At the top, the otherwise transparent vessel 22 comprises a coated portion 26 which is opaque. At the bottom, the vessel 22 is sealed in a pinch seal 28, which is fixed to the base 12.

Projecting from the pinch seal 28 into the interior of the vessel 22 are three holding wires 30*a*, 30*b*, 30*c*. The holding wires 30*a*, 30*b*, 30*c* are further fixed by a holding bar 32 made out quartz glass material and arranged distant from the pinch seal 28. The holding wires 30*a*-30*c* are embedded within the material of the holding bar 32. Further, fixed to the holding wires 30*a*, 30*b*, 30*c* are arranged a first filament 34 (low-beam filament, not shown in FIG. 1) and a second filament 36 (high-beam filament).

Proximate to the first filament 34, a baffle 40 is arranged, welded to one of the holding wires 30*c*. As shown, the baffle 40 is provided to cover the axial extent of the first filament 34 and thus partially shield light emitted from the filament 34 into radial directions. Further, a front portion 42 of the baffle 40, shown in FIG. 2, is arranged in between the first and second filaments 34, 36 and therefore serves to shield the filaments 34, 36 from one another.

As also shown in FIG. 2, the first, low beam filament 34 is connected at one end to a first holding wire 30*a* and at the other end to the baffle 40, which is welded to the third holding wire 30*c*. The second, high-beam filament 36 is fixed to a second holding wire 30*b* and to the third holding wire 30*c*. By these connections, the filaments 34, 36 are both mechanically held at defined positions within the vessel 22 and are electrically connected between the holding wires 30*a*, 30*b*, 30*c*. The holding wires, in turn, are connected internally within the base 12 to electrical contacts 20 protruding from the lower portion of the base 12. Thus, the filaments 34, 36 may be operated by supplying electrical power at the electrical contacts 20.

The filaments 34, 36 are each provided as a single winding structure of filament wire wound around a straight filament axis. An axis of the first filament 34 and an axis of the second filament 36 are arranged in parallel to the longitudinal axis X of the lamp 10.

The baffle 40 comprises a bottom surface 41 from which a front surface, a back surface, and side surfaces extend, which terminate in side edges 48. At the back surface, an attachment tab 52 is integrally formed. The attachment tab 52 serves to connect the filament wire of the first filament 34 to the baffle 40. As shown, the filament wire of the first filament 34 is welded to the attachment tab 52.

As shown in FIG. 1, FIG. 2, a support member 38 is attached to the lower surface 41 of the baffle 40. The support member 38 is made out of a stamped and bent piece of sheet metal material. It comprises a central bar 39 connected to outer bars 43 by legs 37.

As shown in FIG. 1, FIG. 2, the outer bars 43 lie flat against the inner surface of the wall of the vessel 22 within the cylindrical portion 24.

The legs 37 are flexible, so that the baffle 40, attached to the central bar 39 is resiliently supported on the interior surface of the vessel 22. Thus, external forces acting on the baffle 40 due to vibration will still lead to movement of the baffle 40 relative to the vessel 22, however, the movement of the baffle 40 will be limited by the resilient support 38 which rests on the inside of the vessel 22.

As shown, the support member 38 is provided at the back side 41 of the baffle 40, and is thus shaded from the first filament 34 by the baffle 40. Consequently, no optical distortion is caused by the support member 38.

Figure 3:
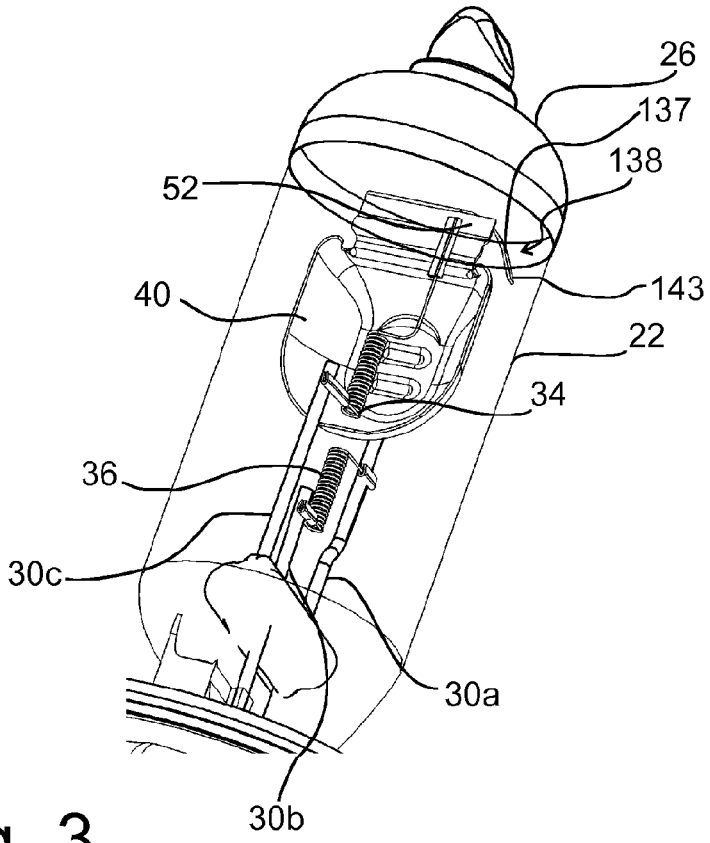
FIG. 3 shows an enlarged perspective view of a portion of a lamp according to a second embodiment.

FIG. 3 shows a part of a lamp according to a second embodiment. The lamp according to the second embodiment differs from the lamp 10 described above only with regard to a different support member. Thus, in the following description only the different support member will be explained in detail for the second embodiment, and like parts of the lamp according to the second embodiment will be designated by like reference numerals.

In the second embodiment as shown in FIG. 3, a support member 138 is formed as a tab integral with the baffle 40. In the example shown, the tab 138 is formed at one side of the attachment tab 52. The tab 138 serving as support member has a flexible leg 137 extending up to the interior of the vessel 22, of which an end 143 rests resiliently against the interior surface thereof.

A further embodiment of a lamp is shown in FIG. 4, which differs from the previous embodiments by a still different support member. In the following description only the different support member will be explained in detail for the third embodiment, and like parts of the lamp according to the third embodiment will be designated by like reference numerals.

In the embodiment according to FIG. 4, a support member 238 is provided as a wire clamped to the attachment tab 52 of the baffle 40. The wire may be made out of tungsten, or preferably molybdenum. The end of the attachment tab 52 is bent to hold the wire 238 which projects to both sides as flexible portions 238*a*, 238*b*, the ends of which are resiliently pressed to the interior of the glass vessel 22.

The lamp with a support member 238 may be manufactured especially easily, because the wire 238 may be provided with a length slightly longer than the diameter of the vessel 22. As the holding wires 30*a*, 30*b*, 30*c*, the baffle 40 and the filaments 34, 46 are inserted into the glass sleeve 22, the wire 238 resiliently bends and the ends abut against the interior of the vessel. The wire 238 may be provided initially straight, such that the bend at the ends 238*a*, 238*b* is formed by insertion. This initial straight form may in particular be used for a wire of lower diameter and resulting lower resilient forces acting on the interior of the vessel wall. Alternatively, in particular for a wire of larger diameter, the wire may be pre-bent at the ends to facilitate insertion into the vessel 22.

The lamp according to the third embodiment also shows good vibration resistance. The resilient contact of the ends of the wire 238 on both sides against the vessel 22 stabilizes the baffle 40, while the flexible nature of the bent ends 238*a*, 238*b* still allows flexibility.

Figure 5:
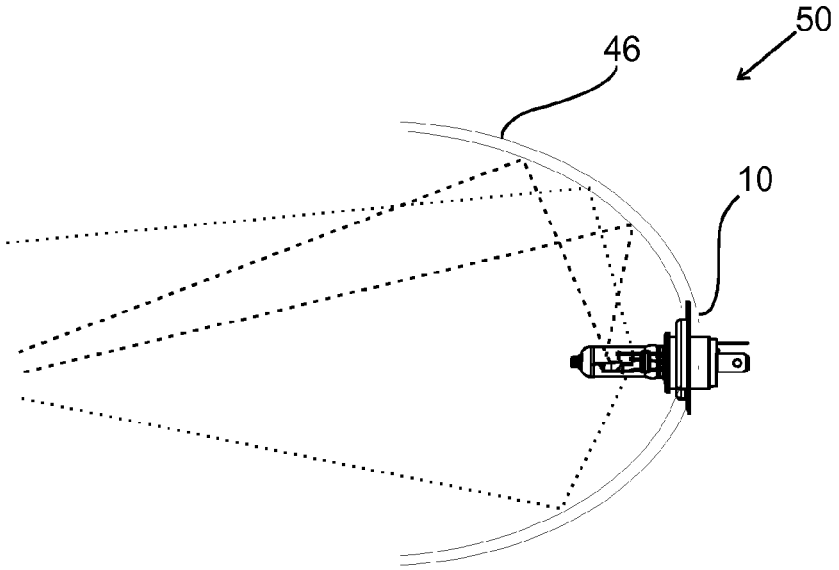
FIG. 5 shows in a schematic representation a vehicle headlight with a lamp according to FIG. 1.

FIG. 5 shows schematically a headlight 50 where the lamp 10 as described above is schematically shown arranged within a reflector 46. Light emitted from the filaments 34, 36 (not shown in FIG. 3) is reflected by the reflector 46 to form different illumination beams. Light from the second (high-beam) filament 36 is shown as a dotted line to be reflected by both the upper and lower part of the reflector 46 to form a high-beam without a bright/dark cutoff.

Light emitted from the first low-beam filament 34 is shown as a dashed line to be partially shielded by the baffle 40 such that only an upper portion of the reflector 46 is illuminated. The upper portion of reflector 46 is shaped to reflect the light from the first filament 34 to form an illumination beam with a horizontal bright/dark cutoff. In the resulting low beam, there is no distortion from the support member 38, because of the position thereof behind the baffle 40.

While the invention has been illustrated and described in detail in the drawings and foregoing description, such illustration and description are to be considered illustrative or exemplary and not restrictive; the invention is not limited to the disclosed embodiment.

Variations from the disclosed embodiments can be understood and effected by those skilled in the art in practicing the claimed invention, from a study of the drawings, the disclosure and the appended claims. In the claims the word "comprising" does not exclude other elements, and the indefinite articles "a" or "an" do not exclude a plurality.

The mere fact that certain measures are recited in mutually different dependent claims does not indicate that a combination of these measures cannot be used to advantage. Any reference signs in the claims should not be construed as limiting the scope.

The invention claimed is:

1. Lamp for automotive vehicle front lighting, comprising
a base providing mechanical and electrical connections,
a burner fixed to said base, said burner comprising a sealed transparent vessel,
at least a first filament arranged within said vessel,
at least one holding wire arranged within said vessel, and
a baffle arranged proximate to said first filament to partially shield light emitted from said first filament, said baffle being fixed to said holding wire,
where said transparent vessel comprises a cylindrical portion surrounding said first filament,
and where a support member is provided including at least a first part fixed to said baffle or to said holding wire, and a second part, said second part being in contact with said cylindrical portion of said vessel, where said support member comprises at least one flexible intermediate part connecting said first and second parts, said baffle or said holding wire being thereby supported resiliently against said vessel.

2. Lamp according to claim 1, wherein
said support member includes a first and a second leg, where each of said legs comprises a second part in contact with said cylindrical portion of said vessel.

3. Lamp according to claim 1, wherein
said second part is in one-sided contact with an interior wall of said vessel.

4. Lamp according to claim 1, wherein said flexible support member is formed in one piece with said baffle.

5. Lamp according to claim 1, wherein said flexible support member is made out of flat metal material.

6. Lamp according to claim 1, wherein said flexible support member is made out of a metal wire.

7. Lamp according to claim 1, wherein said baffle shields said flexible support member from light emitted from said first filament.

8. Lamp according to claim 1, further comprising at least a second filament arranged within said vessel.

9. Lamp according to claim 1, wherein at least three holding wires are arranged within said vessel, and said filaments and said baffle are fixed to said holding wires, where said holding wires extend from a pinch seal of said vessel into the interior of said vessel, and where a holding bar is arranged distant from said pinch seal, said holding bar enclosing said holding wires.

10. Lamp according to claim 1, wherein said base comprises three electrical contact, and three holding wires are arranged extending from a pinch seal of said vessel into the interior of said vessel, each of said holding wires being electrically connected to one of said electrical contacts, where said first filament is electrically connected between a first and a third holding wire, and where a second filament is electrically connected between a second and said third holding wire.

11. Vehicle headlight, comprising a reflector, and a lamp according to claim 1.

* * * * *